US005596310A

United States Patent [19]

Itoh

[11] Patent Number: 5,596,310

[45] Date of Patent: Jan. 21, 1997

[54] RECEIVED LIGHT LEVEL INDICATING SYSTEM FOR BEAM SENSOR

[75] Inventor: Yuji Itoh, Hamamatsu, Japan

[73] Assignee: Atsumi Electric Co., Ltd., Hamamatsu, Japan

[21] Appl. No.: 425,218

[22] Filed: Apr. 18, 1995

Related U.S. Application Data

[63] Continuation of Ser. No. 105,944, Aug. 13, 1993, abandoned.

[30] Foreign Application Priority Data

Aug. 14, 1992 [JP] Japan ..... 4-216850

[51] Int. Cl.[6] ..... G08B 5/00

[52] U.S. Cl. ..... 340/331; 250/491.1; 340/557; 356/153; 356/401

[58] Field of Search ..... 340/331, 500, 340/514, 556, 557, 431, 942, 435, 903, 958; 356/138, 141, 142, 152, 153, 401; 250/221, 491.1

[56] References Cited

U.S. PATENT DOCUMENTS

| | | | |
|---|---|---|---|
| 2,896,089 | 7/1959 | Wesch | 340/903 |
| 3,026,498 | 3/1962 | Galliers | 340/435 |
| 3,514,610 | 5/1970 | Huston et al. | 340/903 |
| 3,765,006 | 10/1973 | Takahashi et al. | 340/331 |
| 4,650,989 | 3/1987 | Frigon | 340/557 |
| 5,015,840 | 5/1991 | Blau | 340/556 |
| 5,085,508 | 2/1992 | Hawkinson | 356/153 |
| 5,089,805 | 2/1992 | Salsman | 340/467 |
| 5,148,147 | 9/1992 | Kobres | 340/467 |
| 5,162,794 | 11/1992 | Seith | 340/435 |

*Primary Examiner*—Brent A. Swarthout

*Attorney, Agent, or Firm*—Armstrong, Westerman, Hattori, McLeland & Naughton

[57] ABSTRACT

A level of received light detected by a light-receiving means (R) is given to both an indication controller (11) and a transmitter (13). The indication controller (11) obtains a flashing frequency corresponding to the given received light level, and flashes an LED (12) at the frequency obtained. The received light level transmitted from a transmitter (13) is demodulated and decoded in a receiver (4) and then given to an indication controller (3). The indication controller (3) obtains a flashing frequency corresponding to the given received light level, and flashes an LED (2) at the frequency obtained. Thus, the operator can recognize the received light level readily and reliably. Accordingly, it is only necessary for the operator to adjust the angle of the projecting optical system of a light-projecting means (T) in the vertical and horizontal directions so that the flashing frequency of the LED (2) lowers and eventually the LED (2) turns off, and to adjust the angle of the receiving optical system of a light-receiving means (R) in the vertical and horizontal directions so that the flashing frequency of the LED (12) lowers and eventually the LED (12) turns off.

2 Claims, 1 Drawing Sheet

| Received light level ($V_R$) | Flashing frequency |
|---|---|
| More than $V_6$ | OFF |
| $V_5 \leqq V_R < V_6$ | $f_6$ |
| $V_4 \leqq V_R < V_5$ | $f_5$ |
| $V_3 \leqq V_R < V_4$ | $f_4$ |
| $V_2 \leqq V_R < V_3$ | $f_3$ |
| $V_1 \leqq V_R < V_2$ | $f_2$ |
| $V_0 \leqq V_R < V_1$ | $f_1$ |
| Less than $V_0$ | ON |

RECEIVED LIGHT LEVEL INDICATING SYSTEM FOR BEAM SENSOR

This application is a continuation of application Ser. No. 08/105,944 filed Aug. 13, 1993, now abandoned.

BACKGROUND OF THE INVENTION

1. Field of the Invention

The present invention relates to a received light level indicating system for a beam sensor.

2. Description of the Related Art

One known type of system for detecting an intruder includes a beam sensor system in which a light projector for projecting an infrared beam (hereinafter referred to simply as "beam") and a light receiver for receiving the beam from the projector are disposed opposite each other. In the beam sensor system, the presence of an intruder is detected on the basis of the quantity of infrared radiation entering the light receiver.

Accordingly, the beam sensor system requires an optical axis adjusting operation in order to make the projecting optical system of the light projector and the receiving optical system of the light receiver face each other accurately. In the optical axis adjustment, the degree of accuracy of alignment between the optical axes of the light projector and the light receiver has heretofore been judged by using a tester. In general, the light receiver is provided with a terminal for outputting the level of received light, e.g., the peak voltage of the received beam, and a tester is connected to the terminal to read the level of the received light. With the conventional practice, a higher voltage level shown by the tester reveals a higher degree of accuracy of alignment made between the two optical axes.

Accordingly, it has heretofore been common practice to effect optical axis adjustment by changing the angles of the projecting and receiving optical systems in the vertical and horizontal directions so that the received light level measured with the tester at the light receiver side reaches a maximum.

However, the conventional practice is considerably troublesome because the tester must always be carried to the job site to effect optical axis adjustment. In addition, because the angles of the optical systems of the beam sensor are changed in the vertical and horizontal directions to effect optical axis adjustment, the received light level changes, and the pointer of the tester moves in a corresponding manner. Since the movement of the pointer of the tester is continuous, it is difficult to judge the position of the maximum received light level and the direction of change of the received light level, that is, whether the received light level is increasing or decreasing.

To cope with these problems, a system has recently been proposed. In the proposed system, a level meter comprising an array of a plurality of light-emitting elements, e.g., LEDs, is provided, and the number of light-emitting elements turning on is controlled in accordance with the received light level. With the proposed system, it is unnecessary to use a tester for each optical axis adjusting operation as in the conventional practice, and it is possible to judge the received light level by the number of light-emitting elements turning on in the level meter. Further, the direction of change of the received light level can surely be understood from the change in the number of light-emitting elements turning on.

However, such a level meter needs a plurality of light-emitting elements and requires a larger number of light-emitting elements in order to indicate the received light level even more finely. Accordingly, the cost rises, and the power consumption increases.

SUMMARY OF THE INVENTION

In view of the above-described problems of the prior art, it is an object of the present invention to provide a received light level indicating system for a beam sensor, which is designed so that it is possible to check the received light level and recognize the change of the received light level readily and reliably without using a tester as in the conventional practice, and that the system can be constructed at a reduced cost.

To attain the above-described object, the present invention provides a received light level indicating system for a beam sensor, having a single light-emitting element, wherein the flashing period of the light-emitting element is stepwisely changed in accordance with the level of received light.

In the present invention, only one light-emitting element is used as an element for indicating the level of received light, and the flashing period of this light-emitting element is stepwisely changed in accordance with the level of received light.

Thus, since only one light-emitting element is used, it is possible to minimize the rise in the cost and the increase in the power consumption.

Further, when the angles of the optical systems of the beam sensor are changed in the vertical and horizontal directions, the level of received light changes continuously. However, since the flashing period of the light-emitting element changes stepwisely, the operator can clearly recognize a change of the received light level and a direction of change of the received light level, that is, whether the received light level is increasing or decreasing. Accordingly, the efficiency of the optical axis adjusting operation can be improved by a large margin in comparison with the prior art.

DESCRIPTION OF THE PREFERRED EMBODIMENTS

Figures 1, 2:
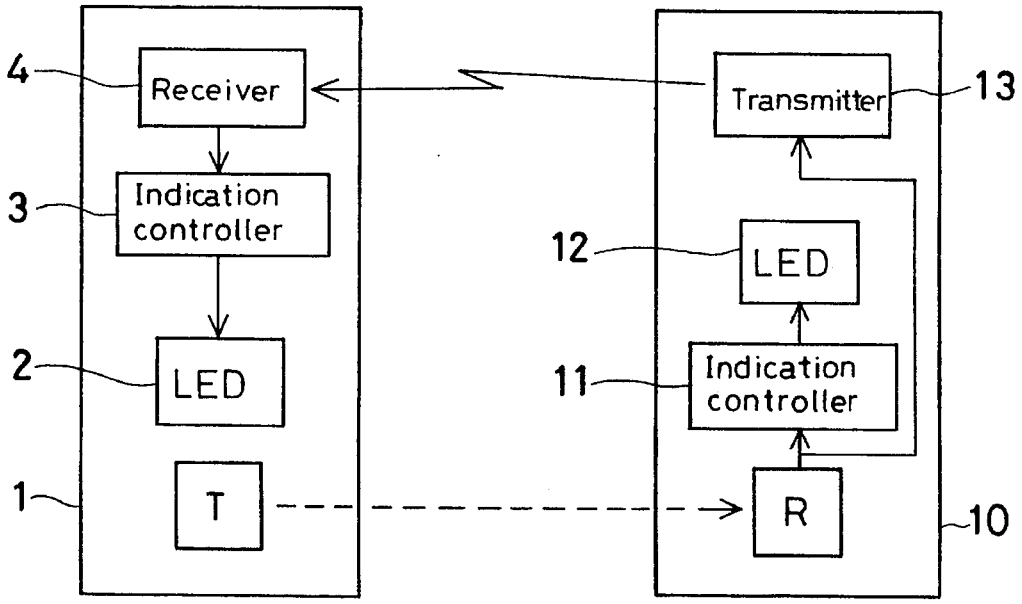
FIG. 1 is a block diagram showing the arrangement of one embodiment of a beam sensor system constructed by using a single-beam sensor adopting the received light level indicating system according to the present invention.
FIG. 2 shows one example of the structure of an indication control table.

One embodiment of the present invention will be described below with reference to the accompanying drawings.

FIG. 1 is a block diagram showing the arrangement of one embodiment of a beam sensor system constructed by using a single-beam sensor adopting the received light level indicating system according to the present invention. In the figure, reference numeral 1 denotes a light projector, 2 an LED, 3 an indication controller, 4 a receiver, 10 a light receiver, 11 an indication controller, 12 an LED, 13 a transmitter, T a light-projecting means, and R a light-receiving means.

The light projector 1 has the light-projecting means T, the LED 2, the indication controller 3, and the receiver 4. The light-projecting means T projects a beam and comprises a projecting optical system including an infrared-emitting element, a driver circuit for the infrared-emitting element, and a reflecting mirror.

The LED 2 indicates the level of light received by the light receiver 10. Although an LED is used in this embodiment, it will be apparent to those skilled in the art that any appropriate light-emitting element may be employed as the LED 2.

The indication controller 3 controls the flashing of the LED 2 on the basis of the received light level at the light receiver 10, which is received by the receiver 4. The indication controller 3 comprises a microprocessor and a peripheral circuit thereof. To effect the flashing control of the LED 2, the indication controller 3 has an indication control table where the flashing frequency of the LED 2 is written relative to the received light level $V_R$, as shown in FIG. 2. When given a received light level $V_R$ from the receiver 4, the indication controller 3 obtains a flashing frequency corresponding to the given received light level $V_R$by referring to the indication control table and flashes the LED 2 at the flashing frequency obtained.

Assuming, for example, that the indication controller 3 has the indication control table as shown in FIG. 2 and the received light level $V_R$ given from the receiver 4 is $V_2 \leqq V_R < V_3$, the indication controller 3 determines the flashing frequency to be $f_3$ and flashes the LED 2 at the frequency $f_3$. In FIG. 2, $V_0<V_1<V_2<V_3<V_4<V_5<V_6$, and $f_1>f_2>f_3>f_4>f_5>f_6$. It has been confirmed that a change in the flashing frequency can reliably be recognized when the flashing frequency is actually set as follows: $f_6$=1 Hz, $f_5$=2.5 Hz, $f_4$=5 Hz, $f_3$=10 Hz, $f_2$=17.5 Hz, and $f_1$=28 Hz.

The receiver 4 receives information on the received light level transmitted from the transmitter 13, demodulates and decodes the received information to obtain the received light level, and gives it to the indication controller 3. It should be noted that the transmission of information from the transmitter 13 to the receiver 4 may be carried out by radio transmission that employs radiowaves, optical transmission, or other proper transmission system.

The light receiver 10 has the light-receiving means R, the indication controller 11, the LED 12, and the transmitter 13. The light-receiving means R is disposed to face opposite to the light-projecting means T. The light-receiving means R comprises an infrared-emitting element, a received light level detecting circuit, a circuit for processing a received light signal, and a reflecting mirror. The light-receiving means R gives the received light level detected to both the indication controller 11 and the transmitter 13.

The indication controller 11 controls the flashing of the LED 12 on the basis of the received light level given from the light-receiving means R. The indication controller 11 comprises a microprocessor and a peripheral circuit thereof. The indication controller 11 has an indication control table such as that shown in FIG. 2 in the same way as in the case of the indication controller 3. When given a received light level from the light-receiving means R, the indication controller 11 obtains a flashing frequency corresponding to the given received light level by referring to the indication control table, and flashes the LED 12 at the flashing frequency obtained.

The LED 12 indicates the level of light received by the light-receiving means R. Although an LED is used in this embodiment, any appropriate light-emitting element may be employed as the LED 12, as in the case of the LED 2.

The transmitter 13 encodes the received light level given from the light-receiving means R according to a predetermined coding system, modulates the coded received light level and transmits it to the receiver 4.

In the foregoing description, each part of the arrangement shown in FIG. 1 has been explained. The following is a description of the operation of each part and the operation conducted by the operator when optical axis adjustment is made.

First, the operator places the light-projecting means T and the light-receiving means R so that they face approximately opposite to each other by visual judgment or using an alidade, and then activates the light projector 1 and the light receiver 10. Consequently, a beam is projected from the light-projecting means T toward the light-receiving means R. The projected beam is received by the light-receiving means R, and the received light level detected by the light-receiving means R is given to both the indication controller 11 and the transmitter 13.

The indication controller 11 obtains a flashing frequency corresponding to the given received light level by referring to the indication control table, and flashes the LED 12 at the frequency obtained. Accordingly, the operator can recognize the level of the received light, that is, the degree of accuracy of alignment made between the respective optical axes of the light-projecting and -receiving means T and R, by observing the flashing condition of the LED 12.

At this time, the received light level detected by the light-receiving means R is transmitted from the transmitter 13 to the receiver 4 where it is decoded and then given to the indication controller 3. The indication controller 3 obtains a flashing frequency corresponding to the given received light level by referring to the indication control table, and flashes the LED2 at the frequency obtained. Accordingly, the operator at the receiver side can recognize the level of light received by the light-receiving means R by observing the flashing condition of the LED 2.

Accordingly, to conduct optical axis adjustment at the light-projecting means side, while observing the flashing condition of the LED 2, the operator adjusts the angle of the projecting optical system of the light-projecting means T in the vertical and horizontal directions so that the flashing frequency lowers and eventually the LED 2 turns off. Similarly, to conduct optical axis adjustment at the light-receiving means side, while observing the flashing condition of the LED 12, the operator adjusts the angle of the receiving optical system of the light-receiving means R so that the flashing frequency lowers and eventually the LED 12 turns off.

With the above-described operation, one cycle of optical axis adjustment is completed. Consequently, the projecting and receiving optical systems are placed to face each other almost correctly. If the above-described optical axis adjustment is conducted once or twice more, the degree of accuracy of the optical axis adjustment can be further increased.

Although one embodiment of the present invention has been described above, it should be noted that the present invention is not necessarily limited to the described embodiment and that various changes and modifications may be imparted thereto. For example, although in the foregoing embodiment the receiver 4 is incorporated in the light projector 1, while the transmitter 13 is incorporated in the light receiver 10, the system may be arranged such that the receiver 4 and the transmitter 13 are formed as members which are separate from the light projector 1 and the light receiver 10 and capable of being attached thereto when optical axis adjustment is to be conducted.

Further, although in the foregoing embodiment the present invention has been described with regard to a single-beam sensor adopting the received light level indicating system according to the present invention, the present invention may also be applied to multi-beam sensors, e.g., a double-beam sensor, in addition to the single-beam sensor, as a matter of course.

What we claim is:

1. A received light level indicating system for a beam sensor, comprising:

a light receiver including a light receiving means for receiving light, a first light-emitting element and a first indication controlling means for controlling said first light-emitting element, wherein the flashing period of said first light-emitting element is stepwisely changed by said first indication controlling means in accordance with a level of light received by said light receiving means, wherein said light receiver further comprises a signal transmitting means for transmitting a signal representing the level of light received by said light receiving means, wherein said received light level indicating system further comprises a light projector including a signal receiving means for receiving the signal transmitted from said signal transmitting means, a light projecting means for projecting light to said light receiving means, a second light-emitting element, and a second indication controlling means for controlling said second light-emitting element, wherein the flashing period of said second light-emitting element is stepwisely changed by said second indication controlling means in accordance with a level of light received by said light receiving means in said light receiver.

2. A received light level indicating system as recited in claim 1, wherein said first indication controlling means and said second indication controlling means each comprises a microprocessor in which is stored an indicating control table used in determining both the flashing period of said first light-emitting element and the flashing period of said second light-emitting element.

* * * * *